US006821218B2

(12) United States Patent
Byrne et al.

(10) Patent No.: US 6,821,218 B2
(45) Date of Patent: Nov. 23, 2004

(54) BALL BAT WITH INFLATABLE GRIP

(75) Inventors: Robert M. Byrne, Lima, OH (US); Kurt F. Hafeken, Sr., Elida, OH (US)

(73) Assignee: American Trim, LLC, Lima, OH (US)

( * ) Notice: Subject to any disclaimer, the term of this patent is extended or adjusted under 35 U.S.C. 154(b) by 0 days.

(21) Appl. No.: 10/689,561

(22) Filed: Oct. 20, 2003

(65) Prior Publication Data

US 2004/0110581 A1 Jun. 10, 2004

Related U.S. Application Data

(60) Provisional application No. 60/423,079, filed on Nov. 1, 2002.

(51) Int. Cl.[7] ..... A63B 59/06

(52) U.S. Cl. ..... 473/568; 473/301; 473/551

(58) Field of Search ..... 473/564–568, 473/457, 514, 520, 549–551, 300–303

(56) References Cited

U.S. PATENT DOCUMENTS

| | | | | | |
|---|---|---|---|---|---|
| RE31,811 | E | * | 1/1985 | Foreman | 473/566 |
| 4,804,183 | A | * | 2/1989 | Doran et al. | 473/523 |
| 5,171,011 | A | * | 12/1992 | Squadroni | 473/519 |
| 5,294,117 | A | * | 3/1994 | Huang | 473/523 |
| 5,345,609 | A | | 9/1994 | Fabry et al. | |
| 5,355,552 | A | * | 10/1994 | Huang | 16/421 |
| 5,364,095 | A | * | 11/1994 | Easton et al. | 473/566 |
| 5,380,002 | A | * | 1/1995 | Spector | 473/519 |
| 5,806,091 | A | | 9/1998 | McHugh | |
| 5,827,142 | A | * | 10/1998 | Rappaport | 473/567 |
| 5,987,705 | A | | 11/1999 | Reynolds | |
| 6,007,439 | A | | 12/1999 | MacKay, Jr. | |
| 6,053,827 | A | | 4/2000 | MacKay, Jr. et al. | |
| 6,099,422 | A | * | 8/2000 | Rappaport et al. | 473/567 |
| 6,428,865 | B1 | | 8/2002 | Huang | |
| 6,443,860 | B1 | | 9/2002 | Byrne et al. | |
| 6,540,627 | B1 | * | 4/2003 | Leal et al. | 473/564 |
| 2002/0142856 | A1 | | 10/2002 | Lindsey | |

* cited by examiner

*Primary Examiner*—Mark S. Graham
(74) *Attorney, Agent, or Firm*—Rankin, Hill, Porter & Clark LLP

(57) ABSTRACT

The present invention provides a ball bat having a knob, a handle portion extending from the knob, a barrel portion extending from the handle portion, and an inflatable grip disposed on the handle portion. The inflatable grip includes an inflatable tubular sleeve through which the handle portion extends, an inflator in fluid communication with the inflatable tubular sleeve for pumping air into the inflatable tubular sleeve, and a release valve in fluid communication with the inflatable tubular sleeve for releasing air from the inflatable tubular sleeve. The ball bat according to the invention allows a batter to selectively pressurize the inflatable tubular sleeve to adjust the rigidity and size of the grip, which improves batter comfort and reduces the amount of shock and vibration transferred from the ball bat to the batter's hands.

13 Claims, 4 Drawing Sheets

BALL BAT WITH INFLATABLE GRIP

BACKGROUND OF THE INVENTION

1. Field of Invention

The present invention relates to a ball bat and, more particularly, to a ball bat having an inflatable grip.

2. Description of Related Art

Ball bats, such as are used in the games of baseball and softball, were originally constructed from a single piece of wood. Early wood bats were made from hickory, which is very strong and dense. Even though the barrels of early wood bats were narrow by modern day standards, such bats were heavy. Most modern wood bats are made from northern white ash, which is strong but not as dense as hickory. Recently, some Major League Baseball players have begun using wood bats made from rock or sugar maple. But, despite advancements in wood ball bat technology over the years, the use of wood ball bats in the games of baseball and softball has sharply declined since the 1970's, when manufacturers began selling aluminum ball bats. At the present time, wood ball bats are generally only used in professional baseball leagues that have rules requiring their use. Metal ball bats are used in most other leagues.

Beginning in the 1970's, most metal ball bats were made from aluminum, which is relatively light, durable and inexpensive. However, the most technologically advanced ball bats are now manufactured from special alloys and/or other materials such as carbon fiber and graphite that are extremely strong and light. Most of the advancements in bat technology in recent years have focused on the barrel portion of the bat, which is the part of the bat that is specifically designed to make contact with the pitched ball.

When a batter strikes a ball with a bat, shock and vibration travels from the portion of the bat that makes contact with the ball to the handle or gripping portion of the bat. This is true whether the bat is constructed of wood, metal and/or other materials. The shock and vibration is transmitted from the handle or grip to the hands of the batter, which can be painful, particularly during could weather. Batters often wear batting gloves to protect their hands from shock and vibration, and to help them obtain a good grip on the bat. While batting gloves and internal vibration dampening structures installed within the interior cavity of a ball bat can be somewhat effective in reducing the amount of vibration and shock transmitted to a batter's hands, there remains substantial room for improvement.

BRIEF SUMMARY OF THE INVENTION

The present invention provides a ball bat having a knob, a handle portion extending from the knob, a barrel portion extending from the handle portion, and an inflatable grip disposed on the handle portion. The inflatable grip comprises an inflatable tubular sleeve through which the handle portion extends, an inflator in fluid communication with the inflatable tubular sleeve for pumping air into the inflatable tubular sleeve, and a release valve in fluid communication with the inflatable tubular sleeve for releasing air from the inflatable tubular sleeve. The ball bat according to the invention allows a batter to selectively pressurize the inflatable tubular sleeve to adjust the rigidity and size of the grip, which improves batter comfort and reduces the amount of shock and vibration transferred from the ball bat to the batter's hands.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figures 1, 2:
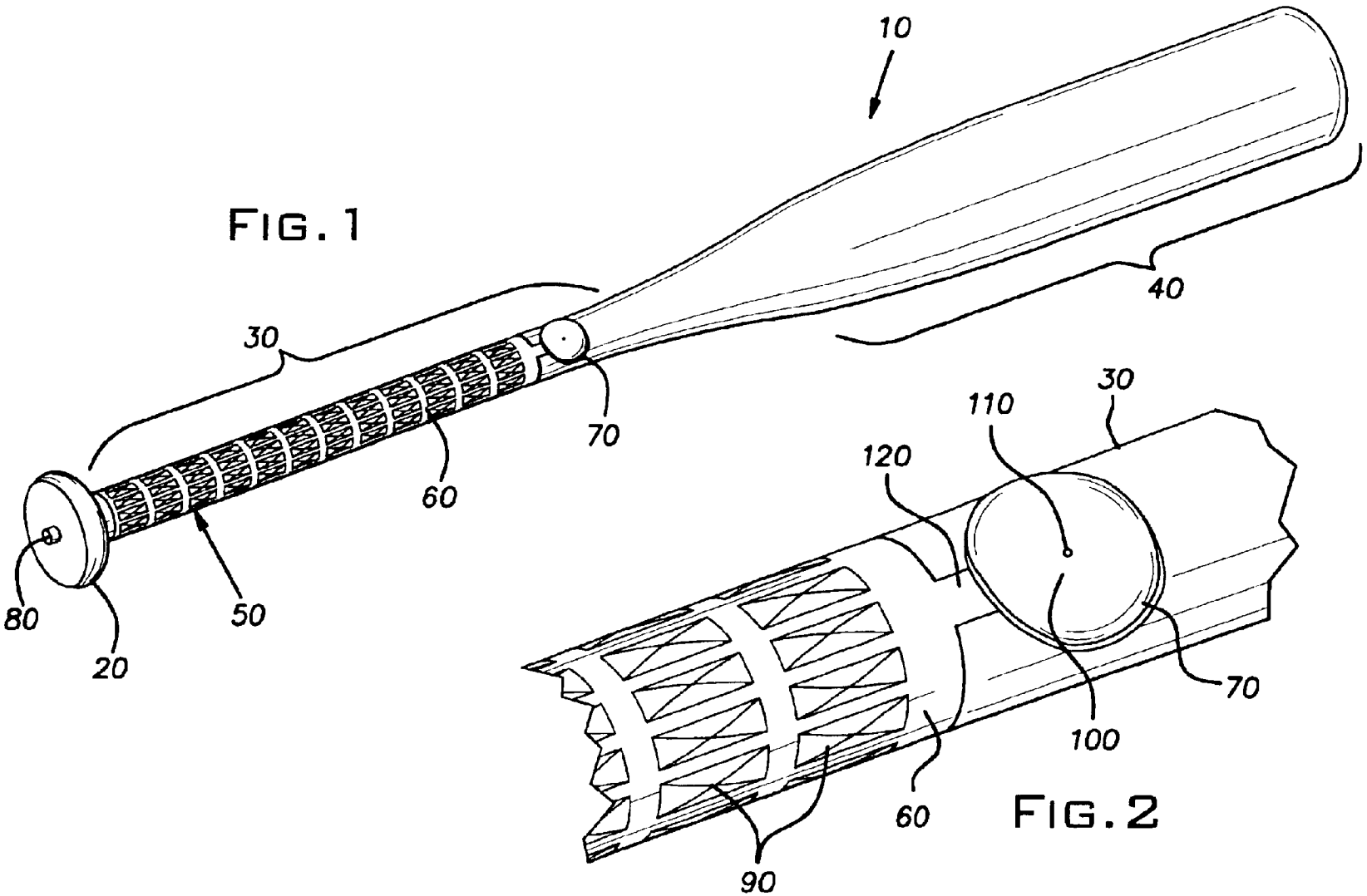
FIG. 1 is a perspective view of a ball bat according to the present invention.
FIG. 2 is a perspective view of a portion of the ball bat shown in FIG. 1.

With reference to FIG. 1, the present invention provides a ball bat 10 having a knob 20, a handle portion 30 that extends from the knob 20, and a barrel portion 40 that extends from the handle portion 30. Preferably, the knob 20, handle portion 30 and barrel portion 40 are all formed of metal. However, other materials can be used including wood and carbon fiber.

An inflatable grip 50 is disposed on the handle portion 30. The inflatable grip 50 comprises an inflatable tubular sleeve 60 through which the handle portion 30 of the ball bat 10 extends. The inflatable grip 50 further comprises an inflator 70 and a release valve 80, both of which are in fluid communication with the inflatable tubular sleeve 60. The inflator 70 allows a batter to selectively pressurize the inflatable tubular sleeve 60. The release valve 80 allows a batter to selectively depressurize the inflatable tubular sleeve 60.

The inflatable tubular sleeve 60 is preferably formed by bonding portions of a first or outer film layer to a second or inner film layer so as to create non-bonded spaces or gaps between the two layers that define air cells 90 or air chambers that are in fluid communication with each other. The first or outer film layer must be a resilient material such as vinyl, rubber or polyurethane. The second or inner film layer can be formed of the same material as the first or outer film layer, or it can be formed of a stiffer, less resilient material such as rubber. Preferably, the first or outer film layer is joined to the second or inner film layer in a regular pattern to form a series of fluidly connected air cells 90 that are arranged in columns and rows. However, it will be appreciated that the arrangement of the air cells 90 is not per se critical, and a random arrangement or pattern can be used. Other materials such as open cell foam and/or gels, can optionally be disposed within the inflatable tubular sleeve 60 to provide further comfort to the batter.

With reference to FIG. 2, the inflator 70 preferably comprises a finger pump. A suitable finger pump is described in Cohen et al., U.S. Pat. No. 5,113,599, which is hereby incorporated by reference for its teachings relative to finger pumps. The exposed or exterior surface 100 of the inflator 70 is preferably formed of a flexible polymeric material such as vinyl or polyurethane. An inlet 110 formed in the exterior surface 100 of the inflator 70 enables air to enter an interior cavity within the inflator 70. The interior cavity of the inflator 70 is filled with a resilient open-cell sponge-like material that retains air. When a batter depresses the exterior surface of the inflator 70 with his or her finger, the batter's finger covers and seals the inlet 110, forcing the air within the open-cells of the sponge-like material through an inflating ribbon 120 and into the fluidly connected air cells within the inflatable tubular sleeve 60. When the batter's finger is released from the exterior surface 100 of the inflator 70, the resilient sponge-like material within the interior cavity expands, allowing the open-cell sponge-like material within the interior cavity of the inflator 70 to refill with air. A check valve (not shown) in the inflating ribbon 120 prevents air from escaping from the air cells 90 in the inflatable tubular sleeve 60 through the inflator 70. A batter can repeatedly depress the finger pump until the inflatable tubular sleeve 60 has reached the desired pressure. The inflator 70 shown in FIG. 2 is round, but the inflator 70 can be of virtually any shape. The inflator 70 is preferably adhered to the handle portion 30 of the ball bat using an adhesive, as shown in FIG. 2, but it can alternatively be adhered to the barrel portion 40 of the ball bat 10.

Figure 3:
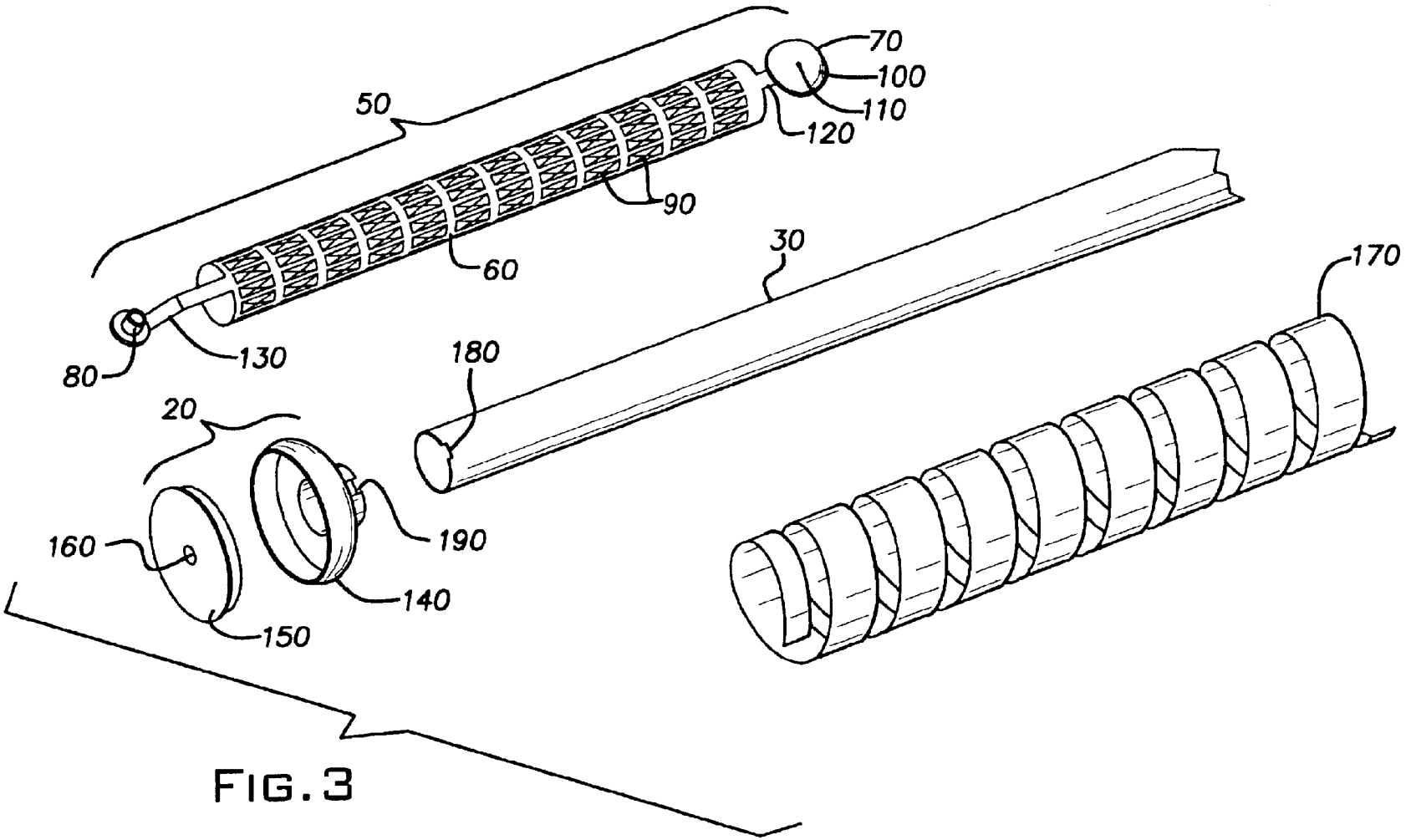
FIG. 3 is an exploded view of a portion of a ball bat according to the invention.

FIG. 3 is an exploded view showing the various components of a preferred embodiment of a ball bat according to the invention. The components include: a bat body having a handle portion 30 and a barrel portion 40 (not shown in FIG. 3); an inflatable grip 50 comprising an inflatable tubular sleeve 60, an inflator 70 fluidly connected to the inflatable tubular sleeve 60 by an inflating ribbon 120, and a release valve 80 fluidly connected to the inflatable tubular sleeve 60 by a deflating ribbon 130; a knob 20, which preferably comprises a collar 140 adapted to receive an end plug 150 having an opening 160 formed therein; and an optional overwrap 170.

The components shown in FIG. 3 can be assembled in accordance with the method of the invention. First, the inflatable tubular sleeve 60 must be properly disposed on handle portion 30 of the bat body. This can be accomplished by sliding the handle portion 30 of the bat body through the inflatable tubular sleeve 60. The inflator 70 can optionally be secured to the handle portion 30 of the bat body using an adhesive, if desired.

Figure 4:
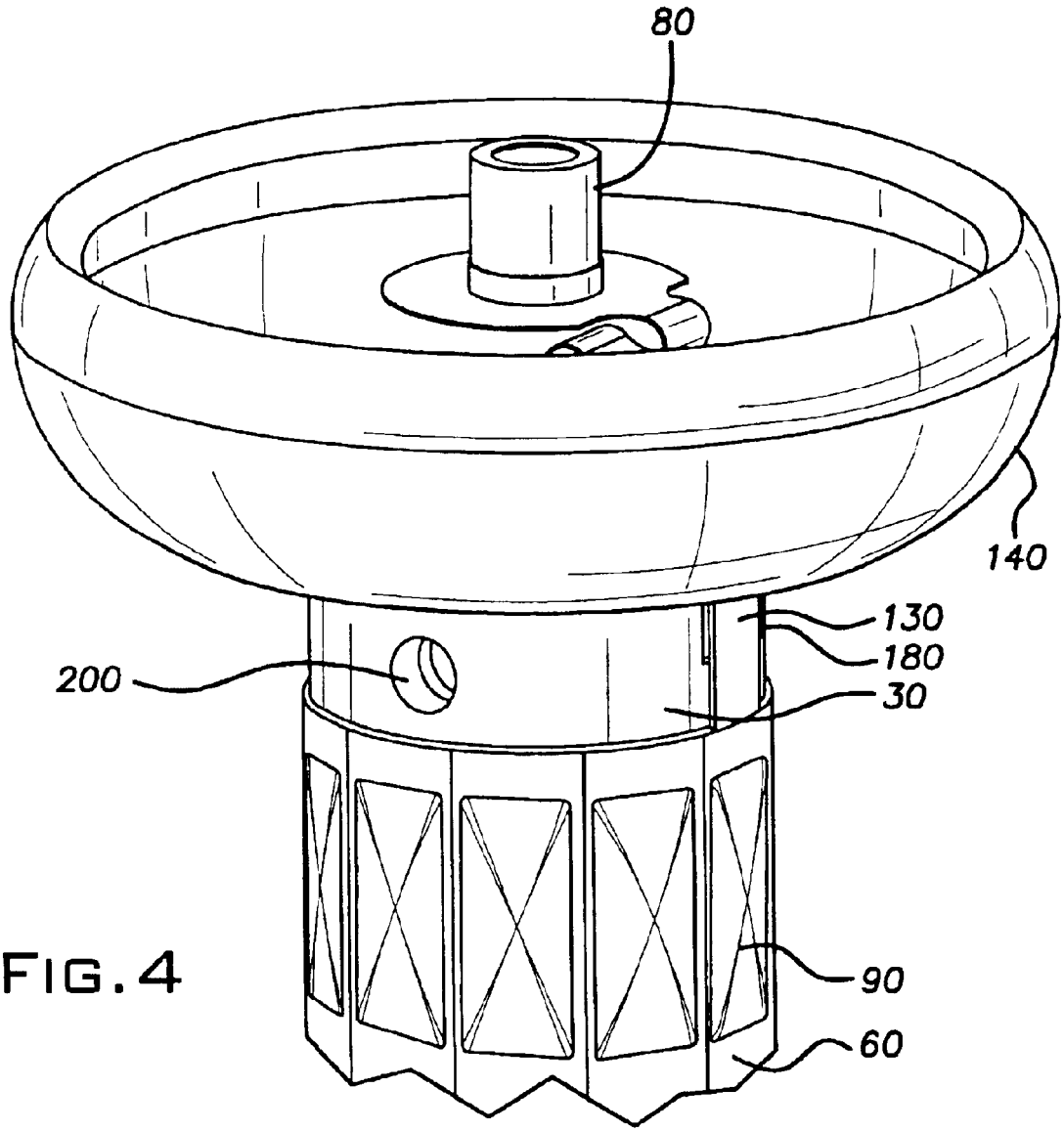
FIG. 4 is a perspective view of a knob of a ball bat according to the invention during assembly.

The deflating ribbon 130 is then positioned in a notch 180 formed in the end of the handle portion 30 of the bat body, and the collar 140 is placed on the end of the handle portion 30 of the bat body such that a notch 190 formed in the collar 140 is aligned with the notch 180 formed in the handle portion 30, such as is shown in FIG. 4. The collar 140 is then secured to the handle portion 30 of the bat body by welding, swaging or other mechanical means. One means of securing the collar 140 to the handle portion 30 of the bat body is to pass a pin through an aligned opening 200 formed in the collar 140 and the handle portion 30. Once the collar 140 is secured to the handle portion 30 of the bat body, the deflating ribbon 130 extends from the inflatable tubular sleeve 60 disposed on the top or exposed surface of the handle portion 30 of the bat body through the aligned notches 180, 190 to the release valve 80, which is accessible through an opening in the collar 140. Preferably, the inflatable tubular sleeve 60 is then moved in a sliding fashion as close to the knob as possible.

Figure 5:
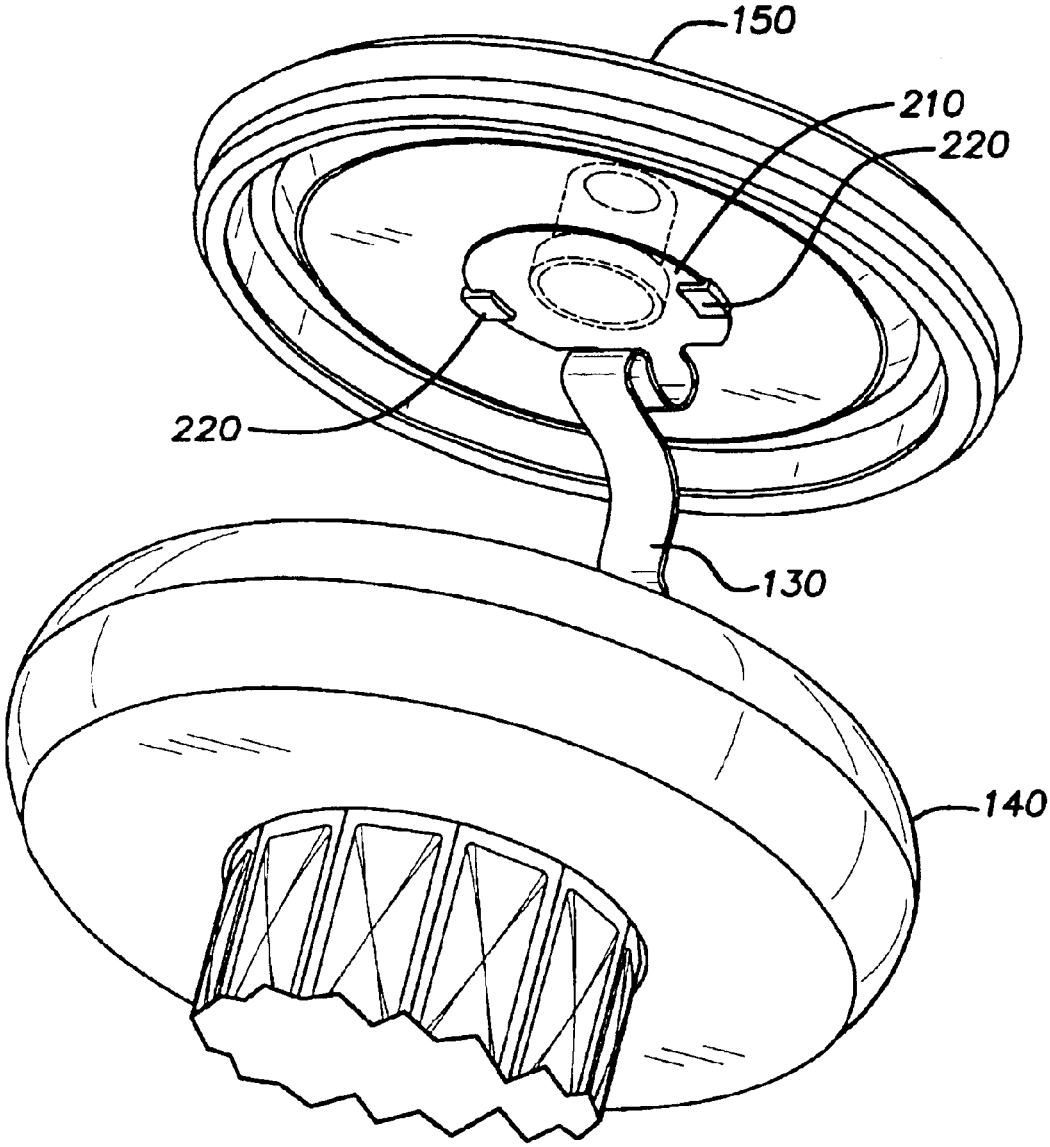
FIG. 5 is a perspective view of an end cap of a ball bat according to the invention during assembly.

With reference to FIG. 5, the release valve 80 is pressed through the opening 160 in the end plug 150. Preferably, the release valve 80 is mounted on a valve disk 210, which is retained to the inner side of the end plug 150 by a plurality of tabs 220. It will be appreciated that the manner in which the release valve 80 is secured to the end plug 150 is not critical, and a variety of means can be used. The end plug 150 is then joined and secured to the collar 140. Preferably, the end plug 150 is formed of a resilient material such as plastic and is configured to snap-fit into the metal collar 140.

Optionally, an overwrap 170 is disposed over the inflatable tubular sleeve 60, preferably in a spiral winding manner. The overwrap 170 is preferably formed of a soft polymeric material, but can be formed of any flexible material typically used in sports equipment. The overwrap 170 helps secure the inflatable grip 50 to the handle portion 30 of the bat body and also provides the batter with an excellent gripping surface. Preferably, the overwrap 170 is air-permeable, and covers both the inflatable tubular sleeve 60 and the inflator 70. The overwrap 170 advantageous protects the air cells 90 in the inflatable tubular sleeve 60 from puncture, and protects the resilient polymeric materials from degrading due to exposure to UV light.

A batter can use the ball bat 10 according to the invention in the games of baseball and softball. The batter uses the inflator 70 to pump air into the air cells 90 disposed in the inflatable tubular sleeve 60. The batter can selectively pressurize the inflatable tubular sleeve 60 until it has the desired circumference and firmness. The air in the inflatable grip 50, in addition to adjusting the size of the grip, provides cushioning to the batter's hands, and also serves to dampen vibration and shock caused by the ball bat striking the ball. Once the batter has taken his or her turn at bat, the batter can use the release valve to depressurize the inflatable grip for storage.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A ball bat having a knob, a handle portion extending from the knob, a barrel portion extending from the handle portion, and an inflatable grip disposed on the handle portion, the inflatable grip comprising:

an inflatable tubular sleeve through which the handle portion extends;

an inflator in fluid communication with the inflatable tubular sleeve for pumping air into the inflatable tubular sleeve;

a release valve in fluid communication with the inflatable tubular sleeve for releasing air from the inflatable tubular sleeve, the release valve extending through an end plug that snaps into the knob; and a deflating ribbon in fluid communication between the release valve and the inflatable tubular sleeve.

2. The ball bat according to claim 1 wherein the knob, handle portion and barrel portion are formed of metal.

3. The ball bat according to claim 1 wherein the inflator is adhered to the handle portion or the barrel portion.

4. The ball bat according to claim 3 further comprising an inflating ribbon in fluid communication between the inflator and the tubular sleeve.

5. The ball bat according to claim 1 wherein the deflating ribbon passes through an opening between the handle portion and the knob.

6. The ball bat according to claim 1 wherein the inflatable tubular sleeve comprises a plurality of air cells that are in fluid communication with each other.

7. The ball bat according to claim 6 wherein the air cells are arranged in columns and rows.

8. The ball bat according to claim 1 further comprising an overwrap disposed over the inflatable tubular sleeve.

9. The ball bat according to claim 8 wherein the overwap is spirally wound over the inflatable tubular sleeve.

10. The ball bat according to claim 8 wherein the overwrap covers the inflator.

11. A method of manufacturing a ball bat comprising:

providing a bat body comprising a handle portion and a barrel portion;

providing an inflatable grip, the inflatable grip comprising an inflatable tubular sleeve and an inflator and a release valve which are in fluid communication with the inflatable tubular sleeve, wherein the release valve is connected to the inflatable tubular sleeve by a deflating ribbon;

sliding the handle portion of the bat body through the inflatable sleeve;

adhering the inflator to the handle portion or the barrel portion of the bat body;

orienting the deflating ribbon in an opening defined by aligned notches formed in a knob and the handle portion before the knob is attached to the handle portion of the bat body;

attaching the knob to the handle portion of the bat body; and securing the release valve to the knob.

12. The method according to claim 11 wherein the knob comprises a collar and an end plug, and the method further comprises:

attaching the release valve to the end plug; and joining the end plug to the collar.

13. The method according to claim 11 further comprising spirally winding an overwrap over the inflatable tubular sleeve.

* * * * *